US010689931B2

(12) United States Patent
Mickey et al.

(10) Patent No.: US 10,689,931 B2
(45) Date of Patent: Jun. 23, 2020

(54) SETTING TOOLS AND ASSEMBLIES FOR SETTING A DOWNHOLE ISOLATION DEVICE SUCH AS A FRAC PLUG

(71) Applicant: Repeat Precision, LLC, Houston, TX (US)

(72) Inventors: Clint Mickey, Canyon Lake, TX (US); Kenneth Kendrick, Pearland, TX (US)

(73) Assignee: Repeat Precision, LLC, Houston, TX (US)

( * ) Notice: Subject to any disclaimer, the term of this patent is extended or adjusted under 35 U.S.C. 154(b) by 0 days.

(21) Appl. No.: 16/288,900

(22) Filed: Feb. 28, 2019

(65) Prior Publication Data

US 2020/0115979 A1 Apr. 16, 2020

Related U.S. Application Data

(63) Continuation of application No. 16/284,717, filed on Feb. 25, 2019.

(60) Provisional application No. 62/743,716, filed on Oct. 10, 2018, provisional application No. 62/776,503, filed on Dec. 7, 2018.

(51) Int. Cl.
*E21B 23/06* (2006.01)
*E21B 33/128* (2006.01)

(52) U.S. Cl.
CPC ..... *E21B 23/065* (2013.01); *E21B 33/128* (2013.01)

(58) Field of Classification Search
CPC .... E21B 23/065; E21B 33/128; E21B 33/134; E21B 43/26
USPC ..... 166/177.5
See application file for complete search history.

(56) References Cited

U.S. PATENT DOCUMENTS

| | | | |
|---|---|---|---|
| 2,189,937 | A | 2/1940 | Broyles |
| 2,266,382 | A | 12/1941 | Quintrell et al. |
| 2,326,404 | A | 8/1943 | Spangler |
| 2,373,006 | A | 4/1945 | Baker |
| 2,618,343 | A | 11/1952 | Conrad |
| 2,637,402 | A | 5/1953 | Baker |
| 2,640,547 | A | 6/1953 | Baker |
| 2,675,877 | A | 4/1954 | Baker |

(Continued)

FOREIGN PATENT DOCUMENTS

| | | | |
|---|---|---|---|
| CA | 2966321 | 5/2016 | |
| CA | 2966321 A1 * | 5/2016 | ..... E21B 23/065 |
| WO | 2020/013949 | 1/2020 | |

*Primary Examiner* — Jennifer H Gay
(74) *Attorney, Agent, or Firm* — Andrus Intellectual Property Law, LLP

(57) ABSTRACT

A setting tool for setting frac plugs and the like can include a mandrel having a chamber for housing expandable gas and a gas port in fluid communication with the chamber; a firing head secured to the mandrel for igniting a power charge to generate pressurized gas within the chamber; a barrel piston housing the mandrel and connected to a sleeve for setting the frac plug; and an expansion region defined between the mandrel and the barrel piston and receiving the pressurized gas which exerts force to cause a stroke of the barrel piston over the mandrel as the expansion region expands axially. The setting tool can include various features, such as certain gas bleed systems, an enhanced shear screw assembly, a bleed port and plug assembly, a scribe line, a particular gas port configuration, a liquid escape conduit, no-shoulder barrel configuration, and/or a low-force design for frac plugs.

28 Claims, 9 Drawing Sheets

(56) References Cited

U.S. PATENT DOCUMENTS 2,713,907 A 7/1955 Kline et al.
2,713,910 A 7/1955 Baker
2,799,343 A 7/1957 Conrad
2,807,325 A 9/1957 Webb
2,815,816 A 12/1957 Baker
2,978,028 A 4/1961 Webb
3,024,843 A 3/1962 Vaughan
3,029,872 A 4/1962 Vaughan
3,029,873 A 4/1962 Vaughan
3,055,430 A 9/1962 Campbell
3,065,295 A 11/1962 Glenn
3,091,293 A 5/1963 Fry
3,125,162 A 3/1964 Briggs, Jr. et al.
3,138,207 A 6/1964 Peppers
3,160,209 A 12/1964 Bonner
3,186,485 A 6/1965 Owen
3,244,232 A 4/1966 Myers
3,255,822 A 6/1966 Conrad
3,303,884 A 2/1967 Medford
3,712,376 A 1/1973 Owen et al.
3,948,321 A 4/1976 Owen et al.
3,973,950 A * 8/1976 Itoh ..... C22C 38/60 420/84
4,311,195 A 1/1982 Mullins
4,569,396 A 2/1986 Brisco
4,830,103 A 5/1989 Blackwell et al.
4,930,573 A 6/1990 Lane et al.
5,024,270 A 6/1991 Bostick
5,133,412 A 7/1992 Coronado
5,203,414 A 4/1993 Hromas et al.
5,316,087 A 5/1994 Manke et al.
5,320,801 A * 6/1994 Culling ..... C22C 30/00 420/49
5,346,014 A 9/1994 Ross
5,392,860 A 2/1995 Ross
5,396,951 A 3/1995 Ross
5,623,993 A 4/1997 Van Buskirk et al.
5,826,652 A 10/1998 Tapp
5,845,669 A 12/1998 Ross
6,149,862 A * 11/2000 Gliklad ..... C22C 38/001 420/104
6,267,828 B1 * 7/2001 Kushida ..... C21D 1/18 148/328
6,269,641 B1 8/2001 Dean
6,702,009 B1 3/2004 Drury et al.
6,874,545 B1 4/2005 Larimer et al.
7,017,672 B2 * 3/2006 Owen, Sr. ..... E21B 23/06 166/123
7,036,602 B2 5/2006 Turley et al.
7,077,212 B2 7/2006 Roesner et al.
7,303,020 B2 12/2007 Bishop et al.
7,708,841 B2 * 5/2010 Saller ..... C22C 38/58 148/327
8,132,627 B2 3/2012 Braddick
8,459,377 B2 6/2013 Moyes
8,887,818 B1 11/2014 Carr et al.
9,453,382 B2 9/2016 Carr et al.
9,464,495 B2 10/2016 Picciotti et al.
9,689,220 B2 6/2017 MacLeod et al.
9,771,769 B2 9/2017 Baker et al.
9,810,035 B1 * 11/2017 Carr ..... E21B 23/065
9,863,209 B2 1/2018 Strickland
9,896,895 B2 2/2018 Richards et al.
10,107,054 B2 10/2018 Drury et al.
10,246,961 B2 * 4/2019 Robertson ..... E21B 23/065
10,443,331 B1 10/2019 Andres et al.
2003/0136476 A1 * 7/2003 O'Hara ..... C22C 38/002 148/334
2004/0216868 A1 * 11/2004 Owen, Sr. ..... E21B 23/06 166/134
2004/0258554 A1 * 12/2004 Radon ..... C22C 30/00 420/12
2005/0145308 A1 * 7/2005 Saller ..... C21D 8/065 148/609
2006/0034724 A1 * 2/2006 Hamano ..... C21D 6/002 420/39
2007/0107913 A1 5/2007 Arnold et al.
2008/0141826 A1 * 6/2008 Marya ..... C22C 38/001 75/331
2009/0301733 A1 * 12/2009 Shuster ..... E21B 43/103 166/378
2011/0120723 A1 * 5/2011 Pugh ..... C22C 38/02 166/369
2013/0140041 A1 6/2013 Allen et al.
2013/0156628 A1 * 6/2013 Forbes Jones ..... C22C 38/42 420/38
2013/0228066 A1 9/2013 Brunner et al.
2013/0299160 A1 11/2013 Lott
2014/0299236 A1 * 10/2014 Anelli ..... C21D 8/105 148/504
2015/0047749 A1 * 2/2015 Hirata ..... C21D 9/08 148/330
2015/0285019 A1 * 10/2015 Wood ..... E21B 23/065 166/63
2015/0308236 A1 * 10/2015 LaGrange ..... E21B 23/065 166/153
2015/0315682 A1 * 11/2015 Jang ..... C21D 9/46 148/645
2015/0330171 A1 11/2015 Cannon et al.
2016/0115753 A1 4/2016 Frazier et al.
2016/0186513 A1 * 6/2016 Robertson ..... E21B 23/065
2016/0297038 A1 10/2016 Hillis et al.
2016/0305192 A1 * 10/2016 Buhler ..... C21D 8/065
2017/0166161 A1 6/2017 Englbrecht et al.
2018/0080298 A1 3/2018 Covalt et al.
2018/0106121 A1 * 4/2018 Griffin ..... E21B 23/065
2018/0274312 A1 * 9/2018 Zhou ..... E21B 43/105
2018/0305997 A1 * 10/2018 Chen ..... E21B 33/1292
2019/0017346 A1 * 1/2019 Kobayashi ..... E21B 33/134
2019/0106956 A1 * 4/2019 Wells ..... E21B 33/12
2019/0178047 A1 * 6/2019 Franks ..... E21B 33/06
2019/0277103 A1 9/2019 Wells et al.
2020/0018132 A1 1/2020 Ham

* cited by examiner

SETTING TOOLS AND ASSEMBLIES FOR SETTING A DOWNHOLE ISOLATION DEVICE SUCH AS A FRAC PLUG

CROSS-REFERENCE TO RELATED APPLICATION(S)

The present application is a continuation of U.S. application Ser. No. 16/284,717, filed Feb. 25, 2019, which claims the benefit of U.S. Provisional Application No. 62/743,716. filed Oct. 10, 2018 and U.S. Provisional Application No. 62/776,503, filed Dec. 7, 2018, and all of which applications are hereby incorporated by reference in their entirety.

TECHNICAL FIELD

The technical field generally relates to downhole setting tools for setting a downhole isolation device, such as a frac plug, in a well located in a subterranean hydrocarbon containing formation.

BACKGROUND

Setting tools can be used to set a downhole device, such as a frac plug, within a well located in a subterranean formation. The setting tool is generally coupled to the frac plug at the surface and the assembly is then run into a horizontal portion of the well, e.g., via wireline. The setting tool is then triggered such that it engages the frac plug to cause the frac plug to be anchored or "set" within the well. The frac plug seals off a portion of the well to facilitate multistage fracturing operations. After the frac plug has been set, the setting tool can be run out of the well so that it can be redressed and used with a subsequent frac plug. Using the setting tool over multiple runs, several frac plugs can be installed within a horizontal well in the context of multistage fracturing operations, for example.

Various types of setting tools can be used to set frac plugs. For example, a setting tool can have a mandrel with a chamber, and a barrel mounted around the mandrel such that upon ignition of a power charge within the chamber a pressurized gas can be generated to cause movement of the barrel over the mandrel so that the barrel can push a setting sleeve to engage the frac plug in the setting operation. An example of such a setting tool is described in U.S. Pat. No. 9,810,035, which is incorporated herein by reference in its entirety. There are still challenges in the operation and manufacture of such setting tools, and there is a need for enhancements in such downhole technologies.

SUMMARY

Downhole setting tools with various features and enhanced functionalities are described herein.

In one example, there is provided a downhole setting tool for setting a frac plug, the downhole setting tool comprising: a mandrel having an upper end and a lower end, the mandrel comprising a chamber for housing expandable gas and a gas port in fluid communication with the chamber, the lower end of the mandrel being couplable to an upper end of a frac plug mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the frac plug; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; and a primary bleed system configured for downhole self-venting and comprising. The primary bleed system includes multiple bleed ports each extending through a wall of the barrel piston and being positioned so as to be isolated from the expansion region before generation of the pressurized gas and moving to be in fluid communication with the expansion region after the stroke allow pressurized gas to exit therethrough, the bleed ports being located on opposed sides of the barrel piston along a circumference that is perpendicular with a longitudinal axis of the barrel piston; bleed plugs disposed in respective bleed ports, each bleed plug comprising threads for threaded engagement with surfaces defining the bleed port and being composed of nylon, the bleed plugs being configured to blow out of the respective bleed ports after the stroke when the bleed ports come into fluid communication with the expansion region; and a circumferential undercut region provided in an inner surface of the barrel piston along the circumference on which the bleed ports are located, the circumferential undercut region facilitating the bleed ports to pass over at least one of the seals during assembly of the mandrel within the barrel piston.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a frac plug mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the frac plug; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; and a primary bleed system comprising a bleed port extending through a wall of the barrel piston and a corresponding bleed plug disposed therein, the bleed port being positioned so as to be isolated from the expansion region before generation of the pressurized gas and moving to be in fluid communication with the expansion region after the stroke to blow out the bleed plug and allow pressurized gas to exit therethrough. The bleed plug includes: a head having a top surface configured to be flush with an adjacent outer surface of the barrel piston; a body comprising threads for threaded engagement with surfaces defining the bleed port; and wherein the bleed plug is composed of a polymeric material.

The downhole setting tool can have one or more optional features. For example, in some implementations, the polymeric material is nylon; the bleed plug has a generally cylindrical shape; the bleed plug is configured to extend within the bleed port and to terminate inset with respect to an inner surface of the wall of the barrel piston; the primary bleed system comprises multiple bleed ports and corresponding bleed plugs; the primary bleed system comprises two bleed ports and corresponding bleed plugs; the two bleed ports are arranged on opposed sides of the barrel piston at 180 degrees from one another; the bleed port comprises an undercut region at a proximal end thereof, and the bleed plug is sized and configured to terminate prior to the undercut region; the primary bleed system is configured to have a bleed port open area of 0.05 $in^2$ to 0.12 $in^2$; the primary bleed system is configured to have a bleed port open area of 0.06 $in^2$ to 0.07 $in^2$; the two bleeds ports each are sized to have an open area of 0.025 $in^2$ to 0.04 $in^2$; and/or the downhole isolation device is a frac plug.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a downhole isolation device mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the downhole isolation device; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; and a primary bleed system comprising multiple bleed ports each extending through a wall of the barrel piston and each having a corresponding bleed plug disposed therein, the bleed ports being positioned so as to be isolated from the expansion region before generation of the pressurized gas and moving to be in fluid communication with the expansion region after the stroke allow pressurized gas to exit therethrough.

The downhole setting tool can have one or more optional features. For example, in some implementations, the multiple bleed ports are arranged around the barrel piston at a same longitudinal location there-along; the primary bleed system comprises two bleed ports and corresponding bleed plugs; the two bleed ports are arranged on opposed sides of the barrel piston at 180 degrees from one another; each or at least one of the bleed ports comprises an undercut region at a proximal end thereof; the bleed ports are identical to each other in shape, size and configuration; the bleed ports are formed by drilling through the wall of the barrel piston; the primary bleed system is configured to have a bleed port open area of 0.05 $in^2$ to 0.12 $in^2$; the primary bleed system is configured to have a bleed port open area of 0.06 $in^2$ to 0.07 $in^2$; each or at least one bleed port is sized to have an open area of 0.025 $in^2$ to 0.04 $in^2$; the bleed ports are defined by surfaces that have threads for receiving the bleed plugs which also have threads; the bleed ports are defined by surfaces that are generally smooth; and/or the downhole isolation device is a frac plug.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a downhole isolation device mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the downhole isolation device; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; and a primary bleed system comprising a bleed port extending through a wall of the barrel piston and a corresponding bleed plug disposed therein, the bleed port being positioned so as to be isolated from the expansion region before generation of the pressurized gas and moving to be in fluid communication with the expansion region after the stroke to blow out the bleed plug and allow pressurized gas to exit therethrough, the bleed port passing over at least one seal during assembly of the mandrel within the barrel piston. The bleed port includes an inlet region in fluid communication with the expansion chamber after the stroke; an outlet region in fluid communication with the inlet region and with an atmosphere outside of the barrel piston; wherein the inlet region comprises an undercut surface that is tapered and continuous with an inner surface of the barrel piston to facilitate passing over the at least one seal during assembly.

The downhole setting tool can have one or more optional features. For example, in some implementations, the undercut surface is generally straight, and optionally has a chamfer that is optionally 10 to 20 degrees or 12 to 18 degrees; the undercut surface is generally concave; the undercut surface is generally convex; the undercut surface is about two to three times wider than a width of the outlet region; the undercut surface defines a grooved region that extends about a circumference of an inner surface of the barrel piston; the primary bleed system comprises multiple bleed ports that are located on the circumference; the multiple bleed ports are two bleed ports located at 180 degrees from one another; the primary bleed system comprises multiple bleed ports; the undercut surface defines a smooth and burr-less surface; and/or the downhole isolation device is a frac plug.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a downhole isolation device mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the downhole isolation device; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; wherein the gas port extends perpendicularly with respect to a longitudinal axis of the setting tool.

The downhole setting tool can have one or more optional features. For example, in some implementations, the gas port comprises two co-linear gas conduits extending from opposed sides of the mandrel; the co-linear gas conduits are cylindrical; the co-linear gas conduits are in fluid communication with a lower end of the chamber of the mandrel; the lower end of the chamber of the mandrel has a conical shape; the co-linear gas conduits are in fluid communication with a lower region of the expansion chamber prior to gas pressurization; and/or the downhole isolation device is a frac plug.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a downhole isolation device mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the downhole isolation device; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; a stroke indication system provided on the mandrel to indicate to an operator whether the barrel piston stroked a predetermined distance with respect to the mandrel.

The downhole setting tool can have one or more optional features. For example, in some implementations, the stroke indication system comprises a scribe line on the mandrel; the scribe line extends circumferentially around the mandrel; the scribe line is etched into the mandrel; the stroke indication system has a single scribe line; the stroke indication system comprises one or more indicia provided on the mandrel; the indicia are recessed with respect to an outer surface of the mandrel; the stroke indication system is configured to indicate whether bleed ports are positioned in fluid communication with the expansion chamber.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a downhole isolation device mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the frac plug; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; an annulus defined between an upper part of the mandrel and a corresponding upper part of the barrel piston; a retainer cap configured to be secured into an upper end of the barrel piston and surrounding an upper portion of the mandrel; a liquid escape conduit configured to provide fluid communication with the annulus to enable liquid to escape the annulus during the stroke and volume reduction of the annulus.

The downhole setting tool can have one or more optional features. For example, the liquid escape conduit can include a groove in an inner surface of the retainer cap, and/or a groove in an outer surface of a portion of the mandrel surrounded by the retainer cap, for example. The total open area defined by a cross-section of the liquid escape conduit is between about 0.15 $in^2$ and about 0.04 $in^2$, between about 0.02 $in^2$ and about 0.03 $in^2$, or between about 0.022 $in^2$ and about 0.028 $in^2$.

In another example, there is provided a downhole setting tool for setting a downhole isolation device, the downhole setting tool comprising: a mandrel having an upper end and a lower end, the mandrel comprising a chamber for housing expandable gas and a gas port in fluid communication with the chamber, the lower end of the mandrel being couplable to an upper end of a downhole isolation device mandrel; a firing head secured to the upper end of the mandrel and configured for igniting a power charge to generate pressurized gas within the chamber; a barrel piston having a central bore configured for housing the mandrel, a lower end of the barrel piston being couplable to a sleeve for setting the frac plug; and an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; wherein the barrel piston has a lower end with an outer diameter without a shoulder, the lower end being configured to be secured directly to an upper portion of a setting sleeve.

The downhole setting tool can have one or more optional features. For example, in some implementations, the lower end of the barrel piston comprises threads for be secured to corresponding threads of the setting sleeve; the setting can further include set screws inserted through corresponding apertures in the upper portion of the setting sleeve and the lower end of the barrel piston to prevent relative rotation therebetween; and/or the barrel piston is further configured so that the setting sleeve can be installed via the upper or lower ends of the barrel piston.

In another example, there is provided a frac plug setting assembly, comprising (i) a setting tool, comprising a mandrel having an upper end and a lower end, the mandrel comprising a chamber for housing expandable gas and a gas port in fluid communication with the chamber, the lower end of the mandrel being couplable to an upper end of a frac plug mandrel, wherein the upper end of the mandrel is configured for coupling to a firing head that enables igniting a power charge to generate pressurized gas within the chamber; a barrel piston having a central bore configured for housing the mandrel, a lower end of the barrel piston being couplable to a sleeve for setting the frac plug; an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially; optionally a retainer cap; (ii) an adapter kit, comprising a setting sleeve having an upper part coupled to the lower end of the barrel piston and a lower part; and a shear cap having an upper portion secured to the lower end of the mandrel, and a lower portion housed within part of the setting sleeve; and (iii) a frac plug, comprising a plug mandrel removably mounted to the lower portion of the shear cap; and a load member arranged in spaced relation with respect to the lower part of the setting sleeve, such that when the barrel strokes over the mandrel the setting sleeve engages the load member while the shear cap disengages from the plug mandrel in order to set the frac plug; wherein (a) the setting tool and the adapter kit are pre-assembled and made from carbon steel having a KSI of 35 to 60, (b) at least one of the mandrel, the barrel piston, and the shear cap is composed of a stronger carbon steel, while at least one of the setting sleeve and the retainer cap is composed of a weaker carbon steel; and/or (c) the carbon steel of the components has one or more of the following properties: a carbon content between 0.35 and 0.5 wt %); a tensile strength between 85,000 psi and 95,000 psi; a yield strength between 70,000 psi and 85,000 psi; an elongation in 2" between 11% and 13%; a reduction in area between 30% and 37%; and a Brinell Hardness between 160 and 185; a carbon content between 0.15 and 0.25 wt %); a tensile strength between 60,000 psi and 70,000 psi; a yield strength between 50,000 psi and 60,000 psi; an elongation in 2" between 14% and 16%; a reduction in area between 38% and 43%; and a Brinell Hardness between 120 and 130.

The downhole setting tool can have one or more optional features. For example, in some implementations, the carbon steel has a KSI of 40 to 60; the carbon steel has a carbon content between 0.15 wt % and 0.5 wt %; the carbon steel has a sulfur content up to 0.05 wt %; the carbon steel has a manganese content between 0.6 and 0.9 wt %; the mandrel and the barrel piston of the setting tool and the shear cap and the setting sleeve of the adapter kit are made from the same type of carbon steel; at least one of the mandrel and the barrel piston of the setting tool and the shear cap and the setting sleeve of the adapter kit is made from a different type of the carbon steel as the other components; the setting tool further comprises a retainer cap configured to be coupled to the barrel piston at an upper end thereof, and surrounding a part of the mandrel at an upper end thereof; the retainer cap is composed of carbon steel having a KSI of 35 to 60; at least one of the mandrel, the barrel piston, and the shear cap is composed of a stronger carbon steel, while at least one of the setting sleeve and the retainer cap is composed of a weaker carbon steel; the mandrel, the barrel piston, and the shear cap are composed of a stronger carbon steel, while the setting sleeve and the retainer cap are composed of a weaker carbon steel; in the stronger carbon steel has one or more of the following properties: a carbon content between 0.35 and 0.5 wt %; a tensile strength between 85,000 psi and 95,000 psi; a yield strength between 70,000 psi and 85,000 psi; an elongation in 2" between 11% and 13%; a reduction in area between 30% and 37%; and a Brinell Hardness between 160 and 185; and the weaker carbon steel has one or more of the following properties: a carbon content between 0.15 and 0.25 wt %); a tensile strength between 60,000 psi and 70,000 psi; a yield strength between 50,000 psi and 60,000 psi; an elongation in 2" between 14% and 16%; a reduction in area between 38% and 43%; and a Brinell Hardness between 120 and 130.

In another example, there is provided a method of setting a frac plug using a single-use disposable frac plug setting assembly, comprising: mounting a frac plug setting assembly as defined hereabove or herein to a wireline; deploying the frac plug setting assembly in a well via the wireline; igniting the power charge and generating an axial force against the setting sleeve to engage the frac plug and set the frac plug against a casing of the well thereby separating the frac plug from a sub-assembly comprising the setting tool and the adapter kit; removing the sub-assembly from the well; disengaging the sub-assembly from the wireline; and disposing of the sub-assembly.

In another example, there is provided a method for multistage fracturing of a reservoir comprising setting a downhole isolation device in a well using the downhole setting tool as defined herein and having one or more of the features described or illustrated in the present description. The method can also include subjecting the isolated well segment to a fracturing operation, and then repeating the isolation and fracturing for multiple segments along the well.

The methods can have various optional features, such as disposing of the sub-assembly comprises keeping the setting tool and the adapter kit attached together; mounting the frac plug setting assembly to the wireline comprises coupling the same to the firing head; disengaging the sub-assembly from the wireline comprises decoupling from the firing head for reuse; the axial force that is generated is at most 55,000 pounds, 50,000 pounds, 45,000 pounds, 40,000 pounds, 30,000 pounds, or 25,000 pounds; and/or the power charge in the firing head is provided to generate the axial force tailored for a pre-determined frac plug size and design.

DETAILED DESCRIPTION

Various techniques are described herein relating to a setting tool for setting a downhole isolation device, such as a frac plug, within a well. The setting tool can be of the type that uses a chamber in which pressurized gas can be generated to force a barrel piston to stroke with respect to the mandrel in order to set the frac plug.

FIGS. 1 to 4 illustrate an embodiment of the setting tool 10. The setting tool 10 can be deployed downhole on a wireline and can be coupled at its lower end to a frac plug via an adapter and at its upper end to other downhole tools used in multistage fracturing operations.

Figure 2:
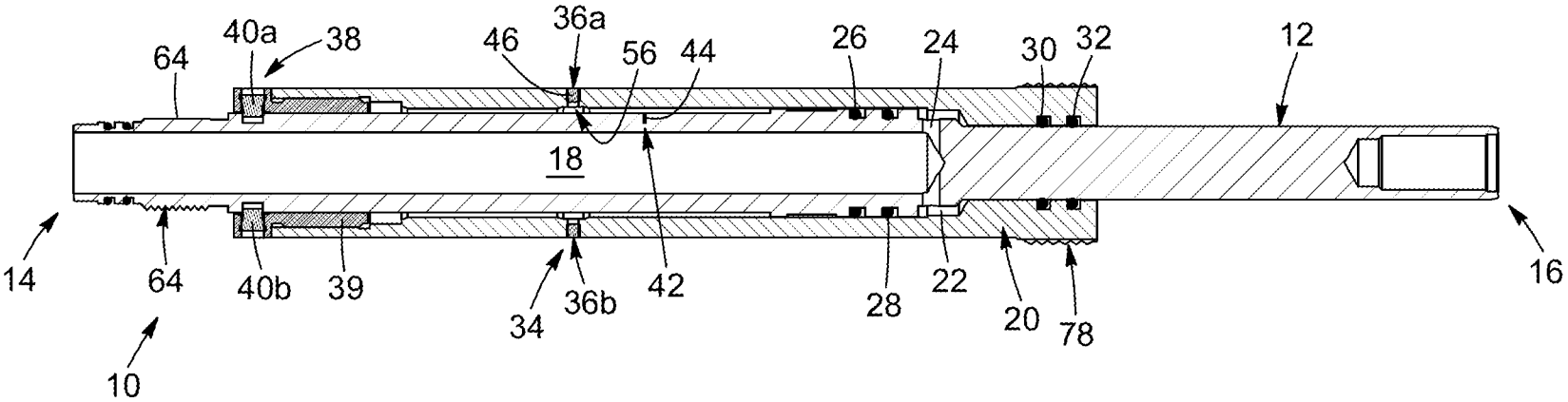
FIG. 2 is a side cut view along A-A of FIG. 1.
Figure 3:
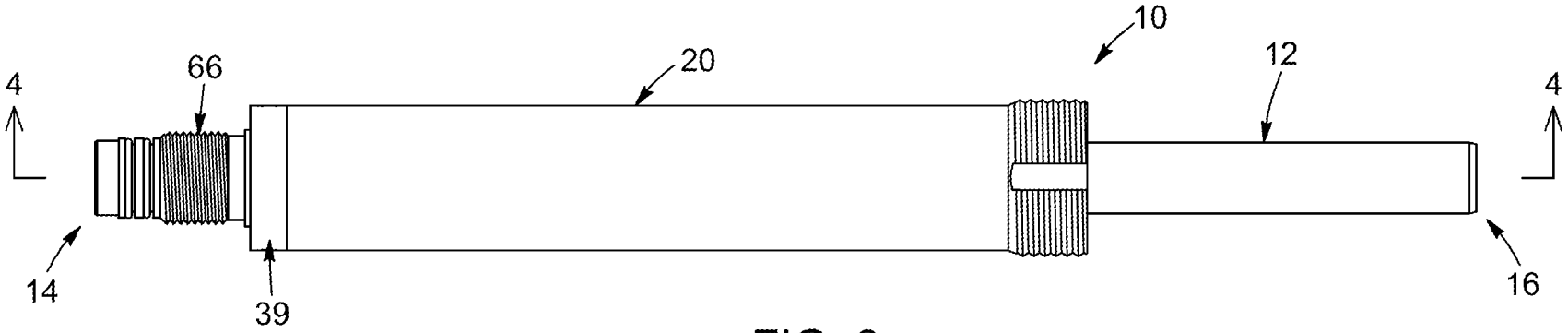
FIG. 3 is another side view of an example setting tool.
Figure 4:
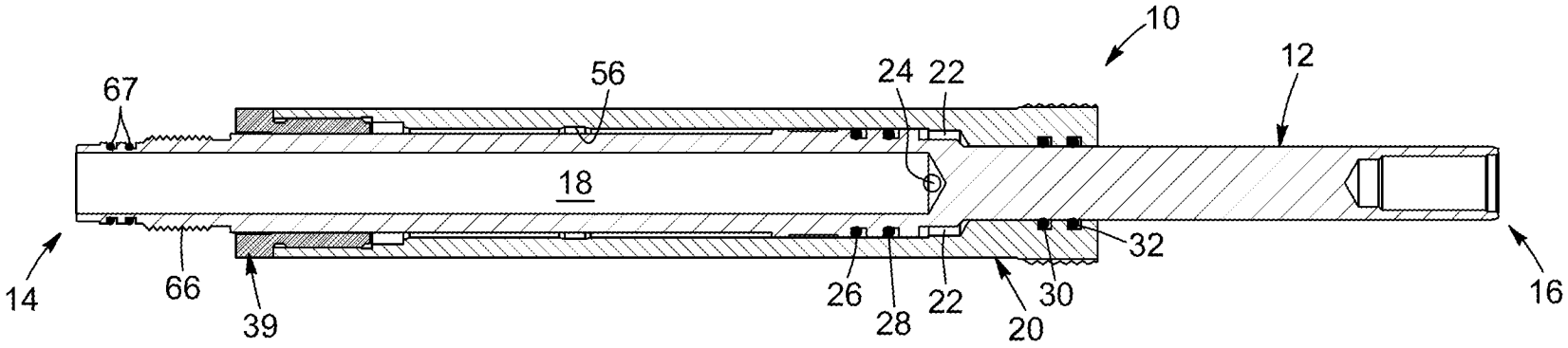
FIG. 4 is a side cut view along B-B of FIG. 3.

Referring to FIGS. 2 and 4, the setting tool 10 includes a mandrel 12 having an upper end 14 and a lower end 16. The mandrel 12 also has a chamber 18 that can be filled with an ignitable compound to generate pressurized gas. The setting tool 10 also includes a barrel piston 20 which includes a central channel that receives the mandrel 12. The barrel piston 20 and the mandrel 12 are also constructed such that when they are assembled in a retracted position as illustrated in FIG. 2 they define an expansion region 22 therebetween. The expansion region 22 and the chamber 18 of the mandrel 12 are in fluid communication, for example via at least one gas port 24. The expansion region 22 is also sealed such that the pressurized gas cannot readily escape the expansion region 22 when in the retracted position.

When a power charge is used to ignite the compound in the chamber and the pressurized gas is formed, the pressure will exert force between the mandrel 12 and the barrel piston 20 within the expansion region 22 and thereby cause the barrel piston 20 to first move downwardly with respect to the mandrel 12 as the expansion region 22 becomes longer in the axial direction. The setting tool's stroke begins with the barrel piston moving downward until the frac plug engages the casing, after which the barrel piston remains generally stationary and the mandrel moves upward due to the pressure in the expansion chamber 22. In one implementation, the expansion region 22 can have a generally annular shape as shown in FIGS. 2 and 4.

Still referring to FIG. 2, a sealing system can be provided between the mandrel 12 and the barrel piston 20 in order to seal in the pressurized gas and thus prevent it from prematurely leaking out of the expansion region 22. The sealing system can include a first pair of sealing rings 26, 28 that can be provided upward of the expansion region 22, and a second pair of sealing rings 30, 32 provided downward with respect to the expansion chamber 22 as shown in FIG. 2. Instead of pairs of sealing rings, there can be a single sealing element or more than two sealing elements at each location. It is also noted that the sealing system can be arranged in various configurations and that the one shown in FIG. 2 is only one example.

As the expansion region 22 expands and the barrel piston 20 strokes over the mandrel 12 in response to the pressurized gas, the barrel piston 20 pushes on an element coupled thereto in order to drive against the frac plug and cause it to set within the well casing. For example, an adapter can be used to functionally couple the frac plug to the setting tool 10 such that the downward force from the barrel piston 20 causes the frac plug to set. More regarding the adapter and the frac plug will be discussed further below.

Once the barrel piston 20 reaches a full stroke position, a primary bleed system 34 will come into fluid communication with the expansion region 22 and enables the pressurized gas to exit the expansion region in order to depressurize the setting tool 10. The primary bleed system 34 thus enables downhole self-venting after the full stroke of the barrel piston 20. The primary bleed system 34 can include a pair of bleed ports 36A, 36B that can be disposed through opposed sides of the barrel piston 20. More regarding the primary bleed system 34 will be described in further detail below.

Figure 1:
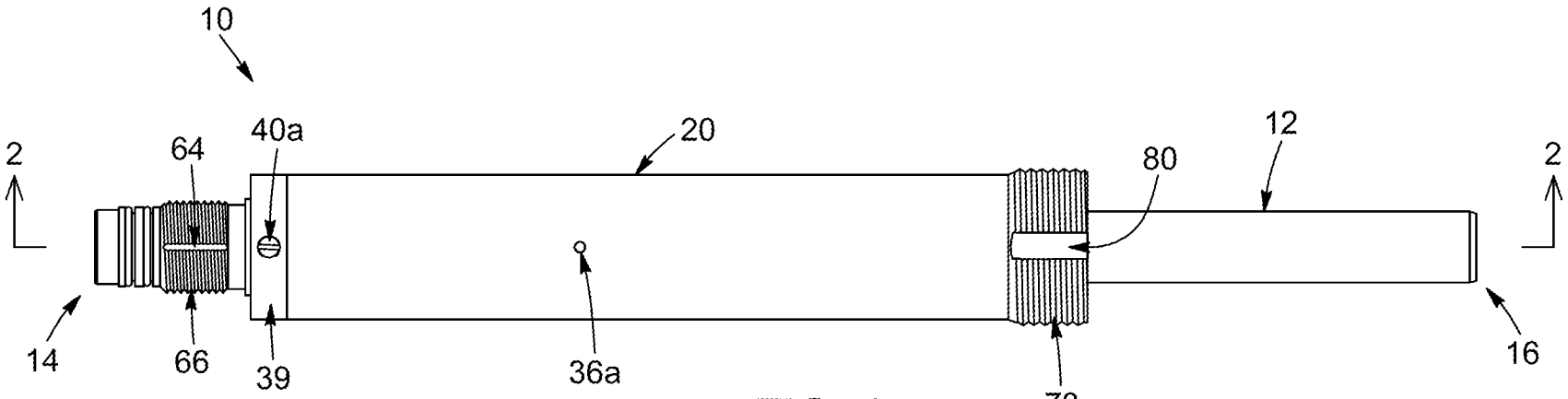
FIG. 1 is a side view of an example setting tool.

Still referring to FIG. 1, a retention system 38 that retains the barrel piston 20 and mandrel 12 together during deployment down the well, can become disconnected through various mechanisms in response to gas pressurization. The retention system 38 can include a pair of shear screws 40A, 40B provided in opposed locations and connecting the barrel piston 20 to the mandrel 12. It should also be noted that other connection mechanisms are possible and more than two shear screws can also be used.

The retention system 38 can be pre-calibrated to require a certain shear force for breaking. For example, the retention system 38 can be provided to shear only in response to pressures at or above about 6,000 lbs and below a maximum rating that would cause excessive pressure on the barrel piston depending on its construction and materials. For example, the shear rating can be between 6,000 lbs and 7,500 lbs, which facilitates enhanced retention while allowing the shearing to occur without damaging the barrel piston even when it is composed of less expensive and lower strength materials. Each shear screw can be rated at about 3,000 lbs, for example, such that a total force of 6,000 lbs is required to shear both shear screw 40A, 40B to enable the barrel piston to be released from and stroke over the mandrel 12.

The retention system 38 can be provided such that it enables relatively high security during run-in of the setting tool 10 to mitigate against accidental stroking of the barrel piston 20 and the mandrel 12. The retention system 38 can also be configured to become easily disengaged in response to the gas pressurization within the chamber 18. In some implementations, the retention system 38 is configured to shear above a threshold level between 6,000 lbs and 9,000 lbs, 6,000 lbs and 8,000 lbs, or 6,000 lbs and 7,000 lbs. When shear screws are used, they can be composed of metallic material such as brass.

The shear screws 40A, 40B can be provided through corresponding openings in a retainer cap 39 which is coupled to the barrel piston 20 as shown in FIG. 2, for example. The retainer cap 39 can have a flange portion at its upper end and a threaded portion at its lower end for threadedly coupling within the lower end of the barrel piston 20.

Figure 9:
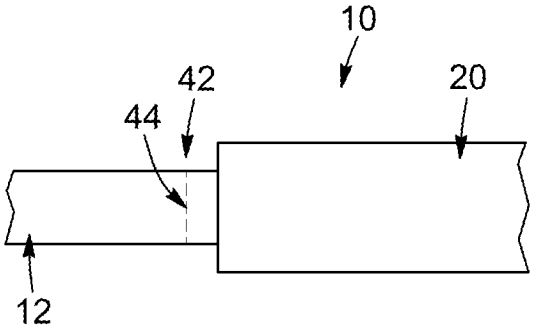
FIG. 9 is a side view schematic of part of a mandrel and a barrel piston of an example setting tool showing a scribe line.

Referring now to FIGS. 2 and 9, the setting tool 10 can also include a stroke indicator system 42 for providing a visual indication of whether the barrel piston 20 completed a full or sufficient stroke with respect to the mandrel 12 during the setting operation. When the setting tool 10 is run out of the well, it can be inspected and the stroke indication system 42 can provide information to an operator regarding the completeness of the stroke that occurred downhole. In one example, the stroke indication system 42 can include at least one scribe line 44 which can be etched at a location of the mandrel 12 beyond which the barrel piston 20 should pass and become visible when the barrel piston 20 completes a full or sufficient stroke and the bleed ports 36A, 36B thus come into fluid communication with the expansion region 22. If the scribe line 44 is visible, this means that the bleed ports 36A, 36B are in fluid communication with the expansion region 22 and thus should have enabled venting. If the scribe line is not visible, this means that a full stroke may not have occurred and the bleed ports 36A, 36B may not have come into fluid communication with the expansion region 22 to enable venting. In the latter case, a secondary bleed system may have to be used to vent the setting tool 10.

The stroke indication system 42 can also include a plurality of scribe lines or other indicia located along an intermediate section of the mandrel 12, where each scribe line or indicia provides a unique indication or otherwise enables an operator to quickly assess the stroke distance of the barrel over the mandrel. Since redressing the work string for redeployment down the well should be conducted as efficiently as possible, the stroke indication system 42 facilitates rapid assessment of whether a full stroke was completed downhole in the previous setting operation and whether self-venting has occurred.

In some implementations, the stroke indication system 42 includes static indicia, such as an etched line, shape, or the like at a pre-determined location along the mandrel 12. The etched line can extend around the circumference of the mandrel 12, or can be located along a segment of it, which can be 10%, 30%, 50%, 70% or more of the circumference. The etched line can be continuous and can be straight. It can also be perpendicular to the longitudinal axis of the mandrel. The etched line can alternatively be formed as a dotted or variable line. The etched line can vary along its length and, if it is oriented with a longitudinal component, it can include different features along its length to help indicate quantitatively or qualitatively the stroke distance that was completed. The stroke indication system 42 can include additional information, such as writing or numbers, to indicate to a user some information regarding the relative position of the barrel piston and the mandrel. The additional information can be etched into the material of the mandrel. The stroke indication system 42 can be provided so that it requires no resetting or manipulation by an operator to be functional for subsequent runs of the setting tool, as the case may be.

Figure 10:
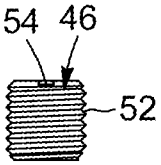
FIG. 10 is a side view schematic of an example bleed plug.

Referring now to FIG. 2 the primary bleed system 34 can include one or more bleed ports 36A, 36B into which respective bleed plugs 46 can be provided. Each bleed plug 46 can have certain optional properties, such as its material, shape and configuration. An example bleed plug 46 is shown in FIGS. 10 and 11.

Figure 11:
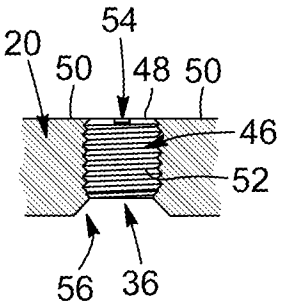
FIG. 11 is a side view partial cut schematic of an example bleed plug in a bleed port.
Figure 12A:
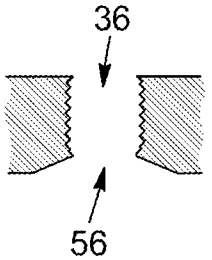
FIGS. 12A-12C are side cut view schematics of example bleed ports.
Figure 12B:
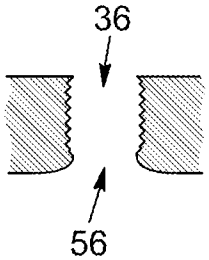
Figure 12C:
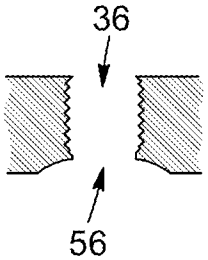

Referring to FIG. 11, each bleed plug 46 can preferably be a threaded screw plug that is configured so that its top surface 48 is flush with an outer surface 50 of the barrel piston 20, and is made of a polymer material, such as nylon. The bleed plug 46 can include threads 52 that mate with corresponding threads of the bleed port 36 or that engage with a smooth surface of the bleed port 36. The bleed plugs facilitate secure mating within the bleed ports to reduce the risk that debris enters through the bleed ports during run-in of the setting tool 10, while allowing the bleed plugs to be blown out of the respective bleed ports 36A, 36B by the gas pressure to enable self-venting after stroking when the bleed ports become located in fluid communication with the expansion region.

By providing multiple bleed plugs in respective bleed ports, the primary bleed system facilitates prevention of debris from entering the setting tool during run-in while enhancing certainty for depressurization by mitigating the risk of one of the ports being blocked and also ensuring depressurization can occur faster which can, in turn, reduce the risk of deformation of the setting tool. The primary bleed system can thus have multiple bleed ports arranged and sized to promote these different functions. For instance, the bleed ports can be arranged equidistantly from each other (e.g., two ports 180 degrees from each other, three ports 120 degrees from each other, four ports 90 degrees from each other, and so on). The bleed ports can be arranged along a common circumference of the barrel piston, or alternatively at different longitudinal locations.

In addition, the bleed ports can be configured and sized to provide an advantageous total open area for the depressurization. For example, the bleed ports can each have an open area of 0.025 in2 to 0.04 in2 or 0.03 to 0.035 in2, and the total open area of the bleed ports can be 0.05 in2 to 0.12 in2, or 0.06 to 0.08 in2, for example. The bleed ports preferably each have a circular cross-section such that the bleed screw plugs can be screwed into the respective bleed ports during assembly. It was found that increasing the total open area of the bleed ports from about 0.03 in2 to about 0.06-0.07 in2 enabled a notable reducing in swelling of the barrel piston.

In addition, the bleed plugs 46 can be flush with the outer surface of the barrel piston 20 in order to avoid snagging on debris and/or other elements within the wellbore which could prematurely dislodge the bleed plugs 46. Alternatively, the bleed plugs could have other shapes and sizes such that they protrude above the outer surface of the barrel piston or are located below.

The bleed plugs 46 are preferably integrally composed of a polymer material, such as nylon, but may also have a composite structure. The threads 52 of the bleed plug 46 are configured to mate with corresponding threads of the bleed ports 36 to provide a secure connection during run-in while being deformed or sheared when under pressure from the pressurized gas in the expansion region after stroking. In the stroked position, the gas blows out at least one of the bleed plugs 46 for depressurizing the setting tool downhole.

Referring to FIG. 11, the bleed plugs 46 can also have a notch 54 in the upper surface to facilitate screwing into the bleed port 36. The upper surface 48 of the bleed plug 46 can also have a distinct color, pattern or finish so that upon visual inspection an operator can see whether one or more of the bleed plugs were blown out downhole. In this case, when the tool is run out of the well and is at surface, an operator can visually identify two indicators that indicate whether or not the tool is still pressurized: a scribe line and a visually distinct bleed plug (or absence of such indicators). This double indicator configuration can provide an enhanced safety feature to the setting tool.

Referring to FIGS. 11 and 12A to 12C, the bleed ports 36A, 36B can each have an inlet region 56 that is tapered or undercut to avoid snagging with components of the mandrel when it is inserted within the barrel piston during assembly at surface. In particular, the undercut inlet region 56 can facilitate avoiding snagging risk with the seals (e.g., sealing rings 26, 28 in FIG. 2) which pass over the inlet region 56 of the bleed ports 36 during assembly. If sealing rings are snagged and damaged by passage over a bleed port which might have a burr or other manufacturing imperfection resulting from drilling through the barrel piston, the sealing function for the expansion region 22 can be lost, which can cause malfunctioning and damage to the setting tool 10 and challenges with the fracturing operation.

Figure 13A:
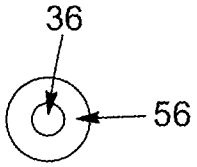
FIGS. 13A-13B are bottom view schematics of example bleed ports.
Figure 13B:
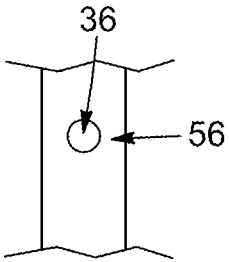

Referring now to FIGS. 13A and 13B, the tapered structure of the inlet region 56 can be provided in various ways and can take certain optional forms. For example, the tapered region can be conical and can extend generally around the main cylindrical section of the bleed port 36, as illustrated in FIG. 13A. Alternatively, the tapered region can be a circumferential groove that is provided along an internal surface of the barrel piston, where the groove is wider than the main cylindrical section of each bleed port 36. The groove can be continuous and can pass over each of the bleed ports that may be located along its path. Depending on the manufacturing method and tooling that may be used, the tapered region can take various forms, e.g., straight angled as in FIG. 12A, smooth convex as in FIG. 12B, or smooth concave as in FIG. 12C.

It is also possible to provide multiple undercut grooves that are longitudinally spaced apart from each other and provide the undercut for bleed ports that are located at different positions along the length of the barrel piston. Indeed, various different patterns and arrangements of bleed ports and undercuts can be provided. Depending on the pattern of the bleed ports, the stroke indication system 42 can also be adapted to indicate the displacement of the barrel piston relative to the mandrel corresponding to different bleed port locations.

Referring back to FIGS. 2 and 4, the gas ports 24, which allow fluid communication between the chamber 18 and the expansion region 22, can be provided as substantially perpendicular with respect to the longitudinal axis of the setting tool 10. This perpendicular orientation can enhance efficient manufacturing compared to angled gas ports which would require more complex manipulation of the component being machined. The gas ports 24 can each have a generally cylindrical shape and can be manufactured by drilling through the wall of the mandrel 12. For example, two gas ports 24 can be provided by two drill passes through the mandrel while the mandrel sits in a secured fashion horizontally, whereas angled ports would require special machine capabilities (which are less efficient and less common) so that the mandrel can be positioned and held at an angle during the machining operations.

In addition, each gas port 24 can have a proximal end communicating with the chamber 18 and a distal end communicating with the expansion region 22. The proximal end can extend at least partly into a conical end section of the chamber 18, as shown in FIGS. 2 and 4. The distal end can communicate with an annular part of the expansion region 22, as shown.

Figure 14:
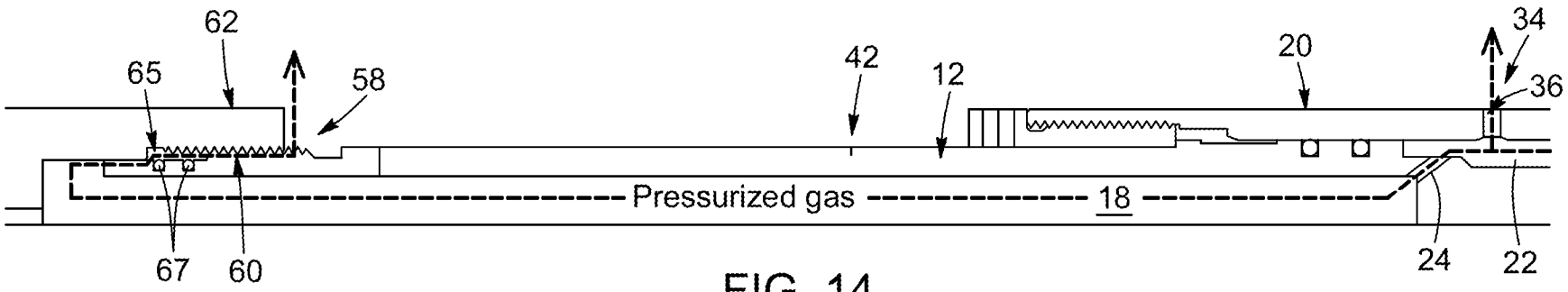
FIG. 14 is a side cut view schematic of part of a setting tool showing bleed systems.

Referring now to FIG. 14, the setting tool 10 can also include a secondary bleed system 58 for ensuring controlled depressurization of the chamber 18 in the event that the primary bleed system 34 is blocked or otherwise does not fully function downhole. In the event that the primary bleed system 34 does not depressurize the setting tool 10, when the setting tool 10 is run out of the well an operator can engage the secondary bleed system 58 in order to ensure controlled depressurization of the setting tool 10. In that sense, the secondary bleed system 58 is configured for surface depressurization whereas the primary bleed system 34 is configured for downhole depressurization or self-venting of the setting tool 10.

In some implementations, the secondary bleed system 14 includes a secondary bleed passage 60 that is configured to be sealed during the downhole setting operation and then opened at surface to enable fluid communication between the chamber 18 and the atmosphere (e.g., when a firing head 62 is unscrewed from the upper end of the mandrel 12). FIG. 14 shows the passage of pressurized gas from the chamber through part of the primary bleed system (bleed port 36) and part of the secondary bleed system (passage 60), for illustration purposes.

Figure 15:
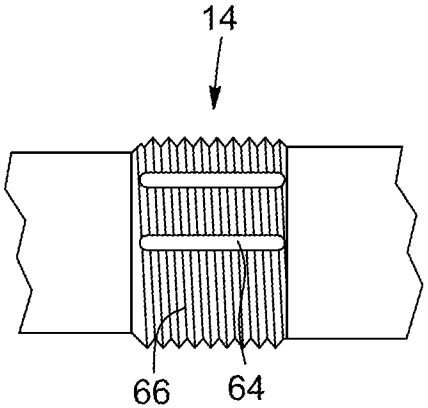
FIG. 15 is a side view schematic of part of a mandrel of a setting tool with a groove through a threaded portion.

Referring now to FIGS. 1, 2 and 15, the secondary bleed passage 60 can include two grooves 64 are each provided longitudinally through the threads on the upper end 14 of the mandrel such that when the firing head is unscrewed from the mandrel 12, the grooves enter into fluid communication with the chamber 18 for receiving pressurized gas at a first end of the grooves while a second end becomes in fluid communication with the atmosphere, thereby allowing pressurized gas to flow from the chamber 18 through the grooves and out of the setting tool. This allows for depressurizing of the setting tool 10 by simply unscrewing the firing head that is coupled to the upper end of the mandrel.

Figure 16:
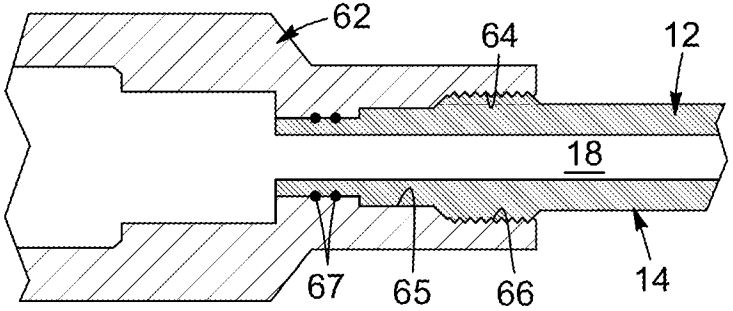
FIG. 16 is a side cut view schematic of part of a setting tool showing a firing head coupled to an upper end of a mandrel.

Referring to FIGS. 14 and 16, the secondary bleed passages can also include respective conduit sections 65 of the inner surface of the firing head 62 that are not in sealing engagement with seals 67 between the mandrel and the firing head when the seals 67 pass over the conduit sections 65 during decoupling of the firing head 62 from the mandrel 12. Note that only one conduit section is shown in these figures but the second conduit section can be on an opposing side at 180 degrees, for example. The conduit sections 65 can simply have a greater diameter compared to the upper section of the firing head 62, so that when the firing head 62 is unscrewed and the seals 67 reach the conduit section 65, the fluid seal is lost and thus the pressurized gas can flow in between the inner surface of the firing head and the outer surface of the mandrel within the conduit sections 65.

Thus, once the seals 67 reach the conduit sections 65, the gas can flow through the conduit sections 65. The grooves 64 and the threaded portion on which they are provided can be configured and sized such that once the conduit sections 65 become in fluid communication with the chamber, the grooves 64 are also in fluid communication with the conduit sections 65 to enable depressurization. In this example, the secondary bleed passage 60 includes the conduit sections 65 and the grooves 64. It should be noted that the grooves 64 can come into fluid communication with the conduit sections 65 before, after or simultaneous when the conduit sections 65 fluidly connects with the chamber 18.

It is also noted that the there may be two, three or more conduits sections and grooves for forming the secondary bleed passage. For instance, the grooves can be distributed around the circumference of the upper end of the mandrel. By providing multiple grooves, the risk of blocking the passage can be reduced. Since the secondary bleed system is proximate to the firing head which produces solid char material, there is a risk that the solids could accumulate within the passage and inhibit depressurization. With a secondary bleed passage that includes multiple possible channels for fluid flow, the risk of blockage can be reduced. Each conduit section can be annular in shape, as illustrated in FIG. 16. Alternatively, the conduit sections could have another form or construction, such as a recess in part of the inner surface of the firing head.

The grooves 64 and the conduit sections 65 can be sized and configured to provide a desired depressurization rate. For example, the grooves 64 and the conduit sections 65 can be provided with pre-determined depths, configurations and sizes while ensuring the structural integrity of the threads and other components. Each groove 64 can be linear extending along the longitudinal axis of the setting tool. Alternatively, the secondary bleed passage 60 could be provided in other ways and can be configured to automatically become open when the firing head is decoupled from the upper end of the mandrel. For example, the firing head and the mandrel can be provided with channels that are misaligned to prevent fluid communication until, during decoupling of the firing head, they become aligned and enable depressurization.

Figure 5:
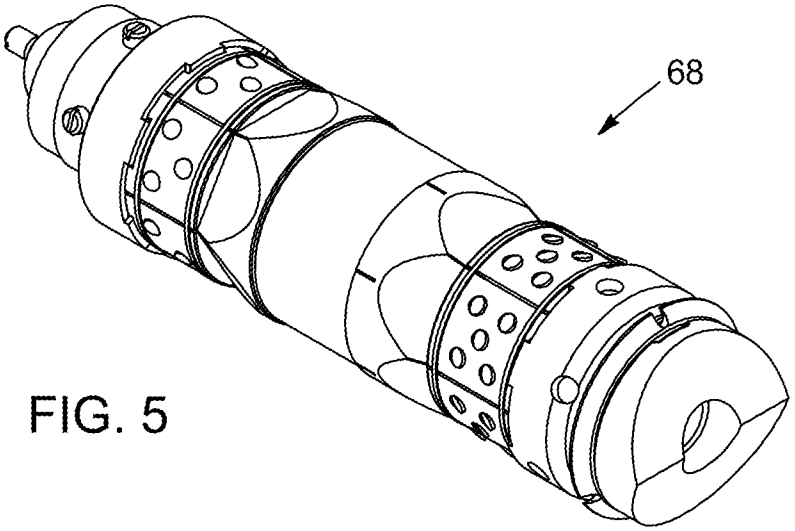
FIG. 5 is a perspective view of an example frac plug.
Figure 6:
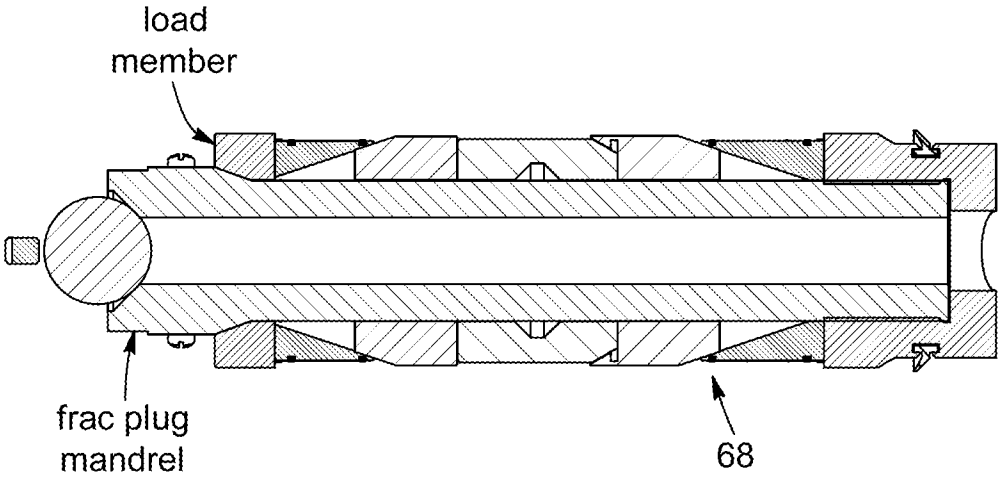
FIG. 6 is a side cut view of an example frac plug.

Referring now to FIGS. 5 and 6, an example frac plug 68 is illustrated. It should be noted that various different designs of frac plugs or other downhole isolation tools can be used in conjunction with the setting tool described herein.

Figure 7:
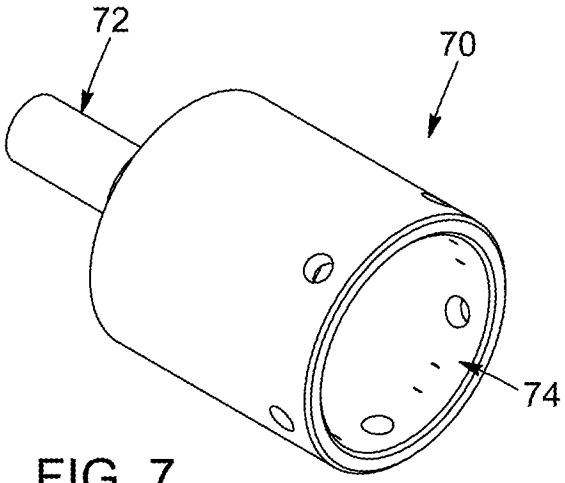
FIG. 7 is a perspective view of a component of an example adapter.
Figure 8:
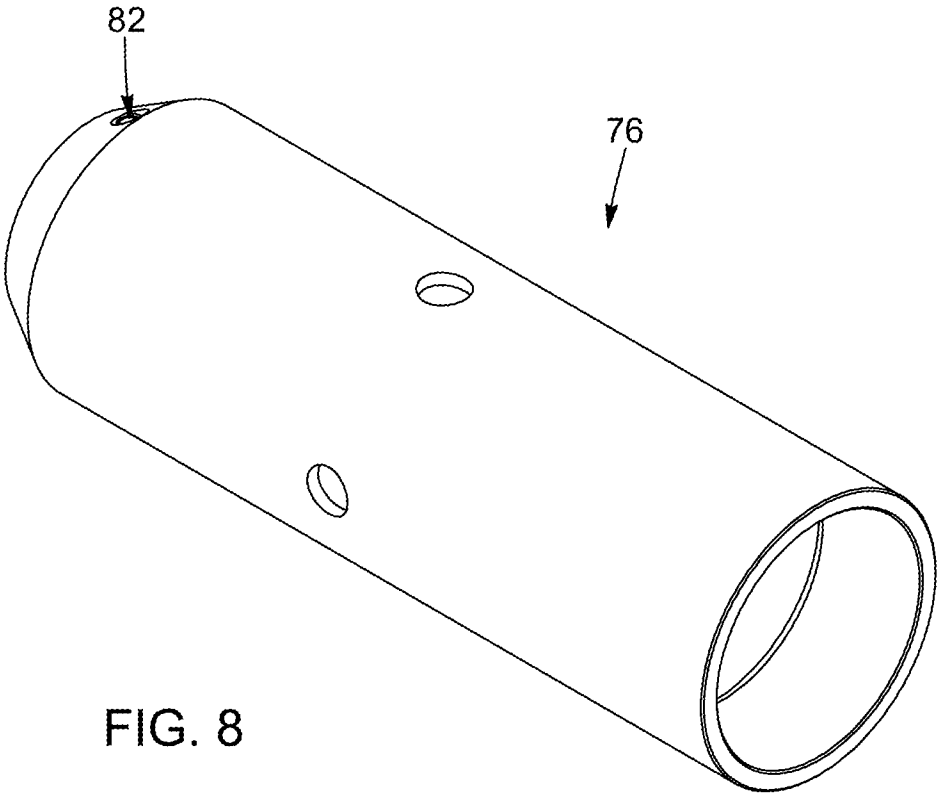
FIG. 8 is a perspective view of another component of an example adapter.

Referring now to FIGS. 7 and 8, example adapter components are illustrated for coupling the frac plug with the setting tool. FIG. 7 shows a first adapter component 70 having a projection 72 that can be coupled within an opening in the lower end of the mandrel of the setting tool and a sleeve section 74 that can be coupled with the mandrel of the frac plug. FIG. 8 shows a second adapter component 76 that can be coupled to a lower end of the barrel piston of the setting tool as well as to a load member of frac plug. The first and second adapter components are slide-able with respect to each other. When the barrel piston strokes, it drives the second adapter component downward to force the second adapter component against the load member, while the mandrel of the setting tool retains the frac plug mandrel via the first adapter component. It should be noted that various different designs of frac plugs and adapters can be used in conjunction with the setting tool described herein.

Figure 17:
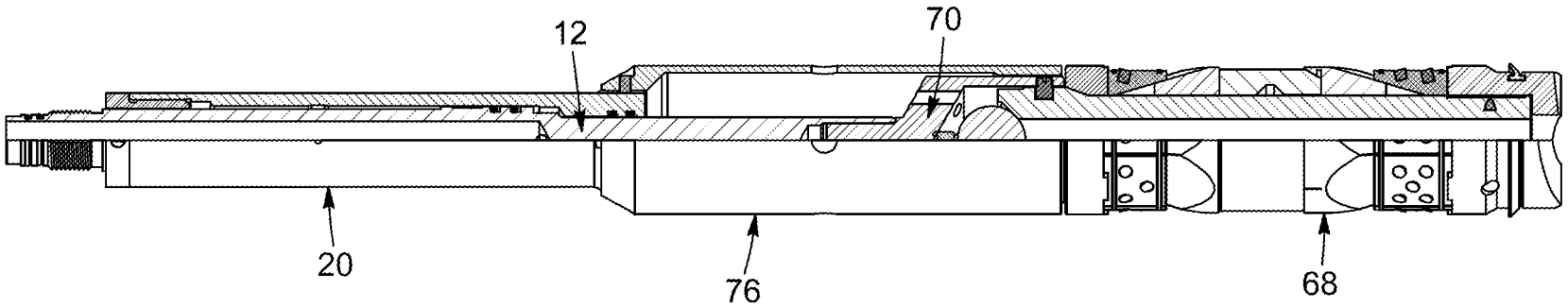
FIG. 17 is a partial cut side view of an assembly that includes a frac plug, an adapter, and a setting tool.
Figure 18:
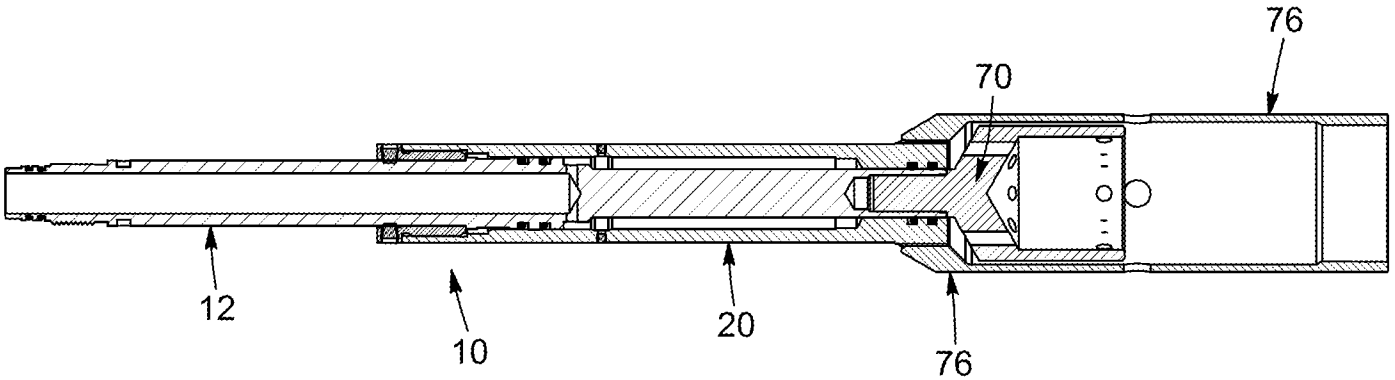
FIG. 18 is a side cut view of a setting tool in a stroked position with an attached adapter.

Referring to FIG. 17, the frac plug 68, adapter components 70 and 76, and the setting tool 10 are shown assembled together. FIG. 17 shows the setting tool in a retracted position while FIG. 18 shows the setting tool in a stroked position where the barrel piston 20 has stroked over the mandrel 12 thus forcing the setting sleeve or second adapter component 76 to move downward while the first adapter component 70 remains fixed with respect to the mandrel 12 of the setting tool 10.

Referring now to FIG. 1, the lower end of the barrel piston can have a threaded section 78 and at least one slot 80. As shown in FIG. 18, the setting sleeve 76 can be coupled to the barrel piston 20 by screwing the upper end of the setting sleeve to the threaded section 78. FIG. 8 shows the setting sleeve 76 which can have openings 82 in its wall in the threaded area to enable a set screw to be inserted to sit in a corresponding slot 80 when assembled to prevent rotation between the setting sleeve and the barrel piston.

Referring back to FIGS. 1 to 4, the mandrel 12 and the barrel piston 20 can have various structural features and dimensions, some of which are illustrated. For example, the mandrel 12 can have an upper portion that is wider than a lower portion, while the central channel of the barrel piston 20 has a corresponding larger portion that accommodates the wider upper portion of the mandrel 12 and a smaller portion that accommodates the narrower portion of the mandrel 12. The seals 26, 28, 30, 32 are arranged between the mandrel and the barrel piston to define a sealed area in which the expansion region 22 can operate. This construction also facilitates defining the expansion region 22 as an annular region between part of a narrower section of the mandrel 12 and part of a wider section of the main channel of the barrel piston 20. Some implementations of the setting tool can also have one or more additional features as described in U.S. Pat. No. 9,810,035 and/or as per commercially available SS Disposable Tool® setting tools available from Diamondback Industries Inc. Implementations of the setting tool can also be used in conjunction with frac plugs, such as those described in U.S. 62/636,352 filed Feb. 28, 2018 and/or as per PurpleSeal Express™ frac plug systems available from Repeat Precision LLC. The frac plugs can be composite frac plugs with parts made from composite materials. The documents referred to herein are incorporated herein by reference in their entirety.

Figure 19:
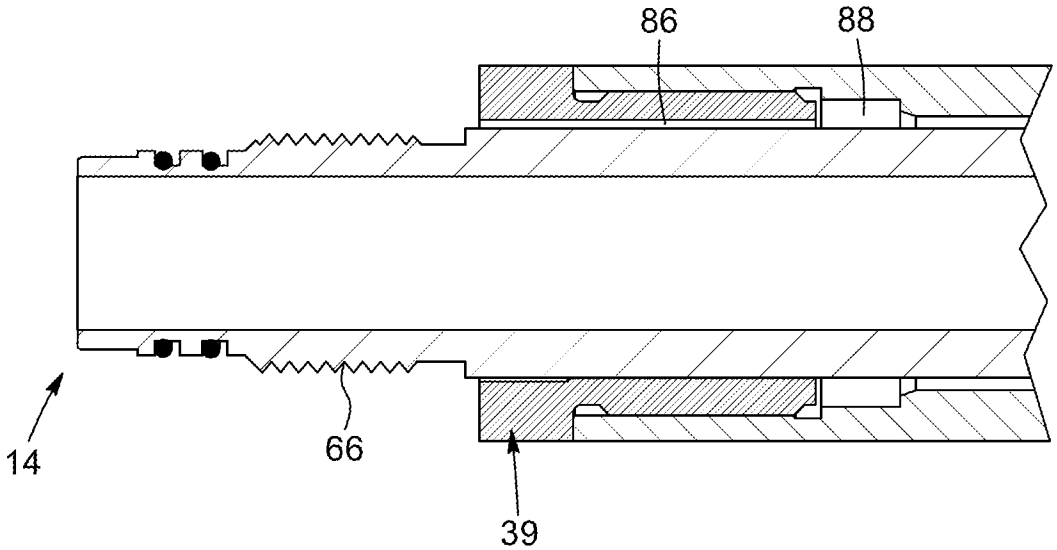
FIG. 19 is a side cut view of part of a setting tool showing a retainer cap with escape path.

Referring now to FIG. 19, the retainer cap 39 can be provided with a groove in its inner surface enabling fluid communication with the annulus to allow fluid to escape, thus providing a liquid escape conduit 86. The groove can be formed as a cut slot running lengthwise along an inner surface of the retainer cap that is around part of the mandrel 12.

As shown in FIG. 2, the retainer cap 39 can thus be secured to the barrel piston 20 with threaded portions, and coupled to the mandrel using the shear screws 40*a*, 40*b*. As shown in FIG. 19, the groove enables fluid communication between the annulus 88 that is defined between the mandrel and the barrel piston, and the external environment. Alternatively, a groove can be provided on a portion of the mandrel spanning the length of the retainer cap 39 and enabling fluid communication between the annulus and the external environment.

The groove provided in the retainer cap 39 facilitates water exiting the annulus during the stroking of the barrel piston 20 with respect to the mandrel 12. During the stroke, incompressible water that has entered the annulus during deployment downhole become pressed as the volume of the annulus decreases. Compare the volume of the anulus shown in FIG. 2 to that shown in FIG. 18 after stroking. Since the volume of the annulus 88 decreases rapidly during stroking, the water in the annulus can press against the surrounding components of the setting tool 10 and causing damage, such as swelling and/or bowing. The setting tool can in some cases be effectively destroyed due to this. Thus, to mitigate such issues, the liquid escape conduit can be provided to provide fluid path conduit for water present in the annulus 88. The liquid escape conduit can be formed as a groove in the inner surface of the retainer cap or part of the outer surface of the mandrel, or by other means such as drilling a longitudinal hole through the body of the retainer cap or machining the mandrel so that the portion surrounded by the retainer cap 39 has a smaller outer diameter enabling fluid flow. It is noted that multiple grooves, holes and/or other channels can be provide together in a single setting tool to provide multiple liquid escape conduits.

The liquid escape conduit can be formed as a linear conduit, e.g., when the groove is provided lengthwise as a straight line. The size, shape and configuration of the liquid escape conduit can be provided based on the desired flow rate of water or other liquid escaping the annulus during stroking, and may depending on the strength of materials used to build the setting tool, the stroke rate, the power charge, and other factors. There may be a single groove, or multiple grooves that are parallel to each other, defining the liquid escape conduit.

In an alternative configuration, the liquid escape conduit can include a liquid bleed port provided through the barrel piston for allowing water to be released during stroking. The liquid bleed port could be provided just down from the retainer cap to communicate with the larger annulus portion.

In some implementations, the liquid escape conduit can be configured to reduce the risk of sand infiltration, which may be done by packing the liquid escape conduit at least partially with grease or another sand barrier compound. The sand barrier compound can be provided so that it can be expelled under pressure from the water within the annulus during stroking, but would otherwise tend to remain within the liquid escape conduit.

The liquid escape conduit can have a cross-sectional area or total open area facilitating release of liquid under pressure to avoid bowing or swelling of the barrel piston and other components of the setting tool. For example, the total open area defined by the groove cross-section can be between about 0.15 in2 and about 0.04 in2, between about 0.02 in2 and about 0.03 in2, or between about 0.022 in2 and about 0.028 in2. The flow area can be increased by such an amount compared to its initial flow area, which is allowed by the small amount of play in between the components. The total open area can also be designed based on the rate of volume reduction of the annulus.

Figure 20:
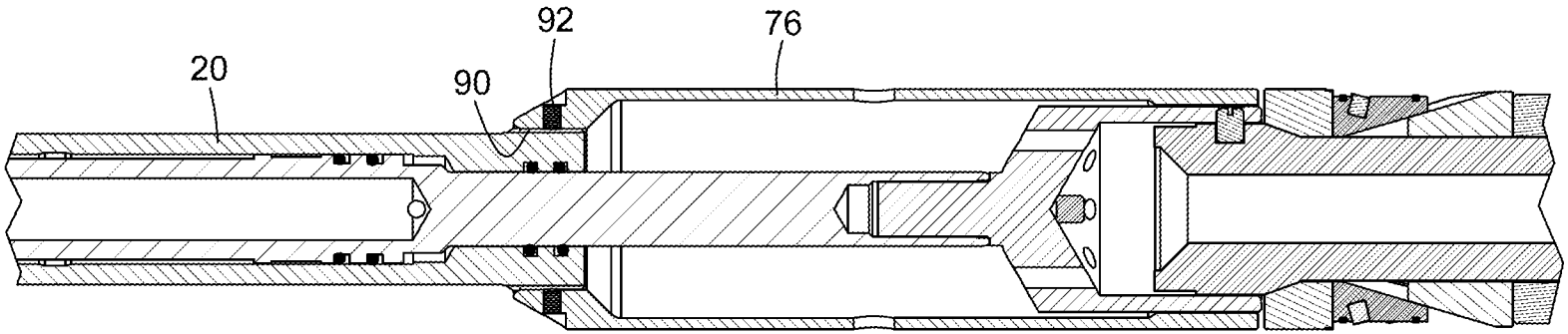
FIG. 20 is a side cut view of part of a setting tool showing a shoulder-less barrel piston and mounted setting sleeve, adapter component, and part of a frac plug.

Turning now to FIG. 20, the setting tool can have a barrel piston with a lower end having a configuration and shape with threads and no shoulder. This configuration facilitates avoiding the use of an adjusting nut. As shown in FIG. 20, the barrel piston 20 would have an outer diameter at its lower end that is generally continuous with its intermediate section. The lower end of the barrel piston 20 includes threads 90 for securing with corresponding threads of the setting sleeve 76 of the adapter. The setting sleeve 76 can include set screws 92 to ensure that it does not unscrew or turn with respect to the barrel piston after installation. Two or more set screws 92 can be used. The setting sleeve 76 can thus be installed with the barrel piston from either direction, if desired.

Figure 21:
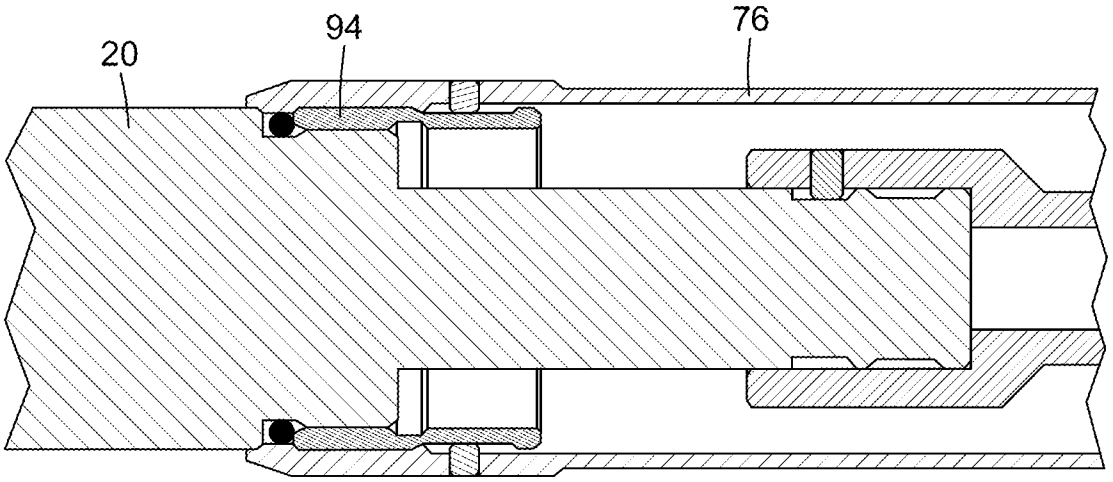
FIG. 21 is a side cut view of part of a setting tool showing a barrel piston with a shoulder construction to which is attached an adjusting nut and a setting sleeve.

Regarding the no-shoulder design illustrated in FIG. 20, a comparison can be made with a shoulder design as shown in FIG. 21. FIG. 21 illustrates a barrel piston with a shoulder into which an adjusting nut 94 is inserted to enable the setting sleeve 76 to be secured with respect to the barrel piston 20. It is noted that example implementations herein can use the shouldered version of the barrel piston, but that a shoulderless barrel piston can provide certain advantages.

In some implementations, there is provided a frac plug setting assembly, as example of which is shown in FIG. 17. The frac plug setting assembly includes a setting tool 10, an adapter kit that includes a setting sleeve 76 and a shear cap 70, and a frac plug 68 that are provided as a pre-assembled unit. The frac plug setting assembly can include a setting tool 10 having one or more features as described herein or having other configurations. The adapter kit can be as shown in FIGS. 17 and 18, and its setting sleeve 76 and shear cap 70 can be pre-mounted to both the setting tool 10 and the frac plug 68 and also composed of low-grade materials facilitating disposal of the entire sub-assembly once the frac plug 68 has been set downhole.

Typically, adapter kits have been made of materials that are reusable, such that a same kit can be used multiple times to set multiple plugs downhole. In addition, adapter kits, frac plugs and setting tools are typically provided as distinct pieces of equipment that must be assembled on-site. Such assembly can lead to drawbacks if the user does not adhere to instructions. In addition, once the frac plug is set downhole and the setting tool and adapter kits are removed from the wellbore, disassembling the adapter kit from the setting tool at surface can lead to various inefficiencies. By providing the adapter kit, the setting tool and the frac plug as a pre-assembled unit, the unit can be deployed with high efficiency and reliability. In addition, constructing both the adapter kit and the setting tool using lower grade materials facilities disposal after use, as the components do not need to be decoupled from each other but can rather be disposed of as a single sub-assembly unit. No disassembly, inspection, maintenance or reassembly are required for the sub-assembly once it is removed from the wireline at surface.

The pre-assembling of the frac plug setting assembly can also facilitate greater surety when assembling the components together, notably as there is some degree of play between certain components and assembly can benefit from small, subtle adjustments. For example, the pre-assembly can facilitate ensuring that the appropriate gap between the setting sleeve 76 and the frac plug is provided. The gap should be appropriately sized to prevent pre-loading or side-loading that may increase the risk of pre-setting. Moreover, a primary benefit of the pre-assembly is that O-ring seals can b e installed in a controlled shop environment instead of on location at the well site, where installation is sometimes conducted in the middle of the night and by wireline employees that may or may not be skilled in the art of redressing and reassembling setting tools. Pre-assembly can facilitate increasing the reliability of the setting tool and allows the operator/wireline company the option of having lower employee requirements on location when a dedicated person would have been on location re-dressing setting tools. There is also a safety aspect to using a lighter weight pre-assembled single use setting tools versus the traditional heavy-duty reusable setting tools which can weigh over 100 lbs.

The frac plug setting assembly is thus pre-assembled using a setting tool and an adapter kit that are made from materials facilitating disposal. More regarding the low-grade materials will be discussed below.

In terms of construction materials, the setting tool and an adapter kit can be made using materials that are both low cost and good machineability. In some examples, the materials can include carbon steel rated at 35 to 65 kilopounds per square inch (KSI), 40 to 60 KSI or 45 to 55 KSI. Such steels can have a lower carbon content and a higher sulfur content than stronger steels typically used for downhole tools. For example, the steel can have a carbon content between 0.15 wt % and 0.50 wt %, the sulfur content can be up to 0.05 wt % or between 0.45 and 0.05 wt %, and a manganese content between 0.6 and 0.9 wt %. The carbon steel can be cold drawn.

In addition, the material can be tailored to each structural component of the frac plug setting assembly, including the mandrel, barrel piston, setting sleeve, shear cap, and retainer cap. For example, the barrel piston, mandrel and shear cap are the higher load components. The barrel piston benefits the most from stronger materials due to the swelling that can occur with pressure from the power charge. The barrel piston and the shear cap are also loaded in tensile during setting of the frac plug. In addition, the during the stroke the threads coupling the mandrel and the shear cap are under higher shear forces, and thus the materials should be selected accordingly. For example, the barrel piston, mandrel and shear cap can be composed of stronger low-grade material, while the setting sleeve and the retainer cap can be composed of a weaker low-grade material.

The stronger low-grade material can be a carbon steel having a higher carbon content (e.g., between 0.35 and 0.5 wt %), while the weaker low-grade material can be a carbon steel having a lower carbon content (e.g., between 0.15 and 0.25 wt %). The stronger low-grade material can be a carbon steel having one or more of the following mechanical properties: a tensile strength between 85,000 psi and 95,000 psi; a yield strength between 70,000 psi and 85,000 psi; an elongation in 2" between 11% and 13%; a reduction in area between 30% and 37%; and a Brinell Hardness between 160 and 185.

The weaker low-grade material can be a carbon steel having one or more of the following mechanical properties: a tensile strength between 60,000 psi and 70,000 psi; a yield strength between 50,000 psi and 60,000 psi; an elongation in 2" between 14% and 16%; a reduction in area between 38% and 43%; and a Brinell Hardness between 120 and 130.

While each of the mandrel, barrel piston, setting sleeve, shear cap, and retainer cap can be composed of the same carbon steel, one or more of such components can be made from different steel materials. In one example, one or both of the setting sleeve and the retainer cap are made from a weaker low-grade carbon steel, which can be the same or different type of carbon steel; while the other components are made from a stronger low-grade carbon steel, which can also be the same or different types of steel. It is also noted that one or more of these components (e.g., the barrel piston) could be made from a medium- or high-grade material that has improved mechanical properties compared to the stronger low-grade material described above.

It is also noted that certain features as described herein, such as the liquid escape conduit, can facilitate the use of lower grade materials for certain components. In the case of the barrel piston, when the liquid escape conduit is used it can allow the pressurized fluid to escape more easily and thus reduces the force exerted on the barrel piston, which in turn reduces the risk of swelling. Thus, the barrel piston can use a weaker material when the liquid escape conduit is provided.

The main components composed of such lower grade steel would be the mandrel, the barrel piston and the retainer cap of the setting tool; and the shear cap and the setting sleeve of the adapter kit. The adapter kit can be adapted for mounting to the shoulderless barrel piston, but could also be adapted with an adjusting nut, where the adjusting nut is preferably also made using lower grade materials. It is also noted that the main components mentioned above can be made from the same low-grade carbon steel, or different low-grade carbon steel materials depending on the functionality and machinability that may be desired.

In operation, a wireline crew may receive the frac plug setting assembly as a single unit and mounts it to the wireline for deployment. The assembly is then run into the well and the frac plug is set in the desired location. The sub-assembly (minus the frac plug) is then run out of the well, removed from the wireline and the firing head, and can be disposed of immediately as scrap material. The firing head can be composed of higher-grade materials, and can be reused with the subsequent frac plug setting assembly, although the firing head could be disposed with the rest of the sub-assembly. The frac plug setting assembly can be provided excluding the firing head, in which case it can mounted to the firing head on site, or it could be provided pre-assembled with the firing head, if desired.

The invention claimed is:

1. A downhole setting tool for setting a downhole isolation device, the downhole setting tool comprising:

a mandrel having an upper end and a lower end, the mandrel comprising a chamber for housing expandable gas and a gas port in fluid communication with the chamber, the lower end of the mandrel being couplable to an upper end of a downhole isolation device mandrel, wherein the upper end of the mandrel is configured for coupling to a firing head that enables igniting a power charge to generate pressurized gas within the chamber;

a barrel piston having a central bore configured for housing the mandrel, a lower end of the barrel piston being couplable to a setting sleeve for setting the downhole isolation device; and an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially;

wherein the barrel piston has an outer diameter to define a continuous cylindrical surface without a shoulder along the length thereof, and the lower end of the barrel piston is configured to be secured directly to an upper portion of the setting sleeve.

2. The downhole setting tool of claim 1, wherein the lower end of the barrel piston comprises threads for being secured to corresponding threads of the setting sleeve.

3. The downhole setting tool of claim 1, further comprising set screws inserted through corresponding apertures in the upper portion of the setting sleeve and the lower end of the barrel piston to prevent relative rotation therebetween.

4. The downhole setting tool of claim 1, wherein the barrel piston is further configured so that the setting sleeve is installable via the upper or lower ends of the barrel piston.

5. The downhole setting tool of claim 1, wherein the downhole setting tool is configured to set a frac plug as the downhole isolation device.

6. The downhole setting tool of claim 5, further comprising a retainer cap configured to be coupled to the barrel piston at an upper end thereof, and surrounding a part of the mandrel at an upper end thereof; and wherein the mandrel, the barrel piston, and the shear cap are composed of a stronger carbon steel, while the setting sleeve and the retainer cap are composed of a weaker carbon steel.

7. The downhole setting tool of claim 6, wherein in the stronger carbon steel has the following properties: a carbon content between 0.35 and 0.5 wt %; a tensile strength between 85,000 psi and 95,000 psi; a yield strength between 70,000 psi and 85,000 psi; an elongation in 2" between 11% and 13%; a reduction in area between 30% and 37%; and a Brinell Hardness between 160 and 185; and wherein in the weaker carbon steel has the following properties: a carbon content between 0.15 and 0.25 wt %; a tensile strength between 60,000 psi and 70,000 psi; a yield strength between 50,000 psi and 60,000 psi; an elongation in 2" between 14% and 16%; a reduction in area between 38% and 43%; and a Brinell Hardness between 120 and 130.

8. The downhole setting tool of claim 1, wherein the lower end of the barrel piston is directly coupled to the setting sleeve.

9. The downhole setting tool of claim 1, comprising an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause the stroke of the barrel piston over the mandrel as the expansion region expands axially.

10. A method of setting a frac plug in a well, comprising:

providing a pre-assembled unit as defined as follows at a controlled shop environment, wherein:

the pre-assembled unit is a frac plug setting assembly, comprising:

a setting tool, comprising:

a mandrel having an upper end and a lower end, the mandrel comprising a chamber for housing expandable gas and a gas port in fluid communication with the chamber, the lower end of the mandrel being couplable to an upper end of a frac plug mandrel, wherein the upper end of the mandrel is configured for coupling to a firing head that enables igniting a power charge to generate pressurized gas within the chamber;

a barrel piston having a central bore configured for housing the mandrel, a lower end of the barrel piston being couplable to a setting sleeve for setting the frac plug; and an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause a stroke of the barrel piston over the mandrel as the expansion region expands axially;

an adapter kit, comprising:

the setting sleeve having an upper part coupled to the lower end of the barrel piston and a lower part; and a shear cap having an upper portion secured to the lower end of the mandrel, and a lower portion housed within part of the setting sleeve;

a frac plug, comprising:

a plug mandrel removably mounted to the lower portion of the shear cap; and a load member arranged in spaced relation with respect to the lower part of the setting sleeve, such that when the barrel strokes over the mandrel the setting sleeve engages the load member while the shear cap disengages from the plug mandrel in order to set the frac plug;

wherein the frac plug is pre-assembled with the setting tool and the adapter kit to provide the pre-assembled unit;

shipping the pre-assembled unit to a well site that includes the well extending into a reservoir;

deploying the pre-assembled unit down the well;

operating the pre-assembled unit such that the barrel strokes over the mandrel and causes the setting sleeve to engage the load member of the frac plug while the shear cap disengages from the plug mandrel, thereby setting the frac plug within the well;

removing the setting tool and the adapter kit as a connected unit from the well; and disposing of the connected unit.

11. A method of setting a downhole isolation device in a well, comprising:

providing a pre-assembled unit at a first location, wherein the pre-assembled unit comprises:

a setting tool, comprising:

a mandrel having an upper end and a lower end, the mandrel comprising a chamber for housing expandable gas and a gas port in fluid communication with the chamber, the lower end of the mandrel being couplable to an upper end of a downhole isolation device mandrel, wherein the upper end of the mandrel is configured for coupling to a firing head that enables igniting a power charge to generate pressurized gas within the chamber; and a barrel piston having a central bore configured for housing the mandrel, a lower end of the barrel piston being couplable to a setting sleeve for setting the downhole isolation device;

wherein the mandrel and the barrel piston are configured to enable the pressurized gas to exert force on the mandrel and the barrel piston to cause a stroke of the barrel piston over the mandrel;

an adapter kit, comprising:

the setting sleeve having an upper part coupled to the lower end of the barrel piston and a lower part; and a shear cap having an upper portion secured to the lower end of the mandrel, and a lower portion;

a downhole isolation device, comprising:

the downhole isolation device mandrel removably mounted to the lower portion of the shear cap; and a load member arranged in spaced relation with respect to the lower part of the setting sleeve, such that when the barrel strokes over the mandrel the setting sleeve engages the load member while the shear cap disengages from the plug mandrel in order to set the frac plug;

wherein the downhole isolation device is pre-assembled with the setting tool and the adapter kit to provide the pre-assembled unit;

shipping the pre-assembled unit to a well site that includes the well extending into a reservoir;

deploying the pre-assembled unit down the well;

operating the pre-assembled unit such that the barrel strokes over the mandrel and causes the setting sleeve to engage the load member of the downhole isolation device while the shear cap disengages from the downhole isolation device mandrel, thereby setting the downhole isolation device within the well; and removing the setting tool and the adapter kit as a connected unit from the well.

12. The method of claim 11, wherein the first location is a controlled shop environment.

13. The method of claim 11, wherein the downhole isolation device is a frac plug.

14. The method of claim 11, further comprising disposing of the connected unit after removal from the well.

15. The method of claim 11, wherein the lower portion of the shear cap is housed within part of the setting sleeve.

16. The method of claim 11, wherein the deploying of the pre-assembled unit down the well comprises:

mounting the firing head to the pre-assembled unit;

mounting the pre-assembled unit to a wireline; and running the wireline-mounted pre-assembled unit into the well.

17. The method of claim 16, further comprising:

removing the connected unit from the wireline and the firing head.

18. The method of claim 17, further comprising:

disposing of the connected unit as scrap material.

19. The method of claim 11, wherein the setting tool and the downhole isolation device are pre-assembled at the first location so as to provide a predetermined gap between the setting sleeve and the downhole isolation device.

20. The method of claim 19, wherein the predetermined gap is sized to prevent pre-loading that would increase the risk of pre-setting during deployment of the pre-assembled unit.

21. The method of claim 19, wherein the predetermined gap is sized to prevent side-loading that would increase the risk of pre-setting during deployment of the pre-assembled unit.

22. The method of claim 11, wherein the pre-assembled unit is provided at the first location such that seals have been installed in a controlled shop environment.

23. The method of claim 22, wherein the seals comprise O-ring seals.

24. The method of claim 11, wherein the mandrel, the barrel piston, the setting sleeve and the shear cap are made from carbon steel.

25. The method of claim 24, wherein the carbon steel has a yield strength of 35 to 60 KSI.

26. The method of claim 25, wherein the setting tool further comprises a retainer cap configured to be coupled to the barrel piston at an upper end thereof, and surrounding a part of the mandrel at the upper end thereof; and wherein the retainer cap is also made of the carbon steel having the yield strength of 35 to 60 KSI.

27. The method of claim 24, wherein the carbon steel has a yield strength of 45 to 55 KSI.

28. The method of claim 11, wherein the setting tool further comprises an expansion region defined between the mandrel and the barrel piston and being in fluid communication with the gas port so as to receive the pressurized gas, the expansion region being further defined by seals provided in between the mandrel and the barrel piston, thereby enabling the pressurized gas to exert force on the mandrel and the barrel piston to cause the stroke of the barrel piston over the mandrel as the expansion region expands axially.

* * * * *